US006125811A

United States Patent [19]

Koriyama et al.

[11] Patent Number: 6,125,811

[45] Date of Patent: Oct. 3, 2000

[54] ENGINE CYLINDER BLOCK

[75] Inventors: Masao Koriyama; Hitoshi Uema, both of Iwata, Japan

[73] Assignee: Yamaha Hatsudoki Kabushiki Kaisha, Iwata, Japan

[21] Appl. No.: 09/208,662

[22] Filed: Dec. 10, 1998

[30] Foreign Application Priority Data

Dec. 10, 1997 [JP] Japan ..... 9-340028
Mar. 31, 1998 [JP] Japan ..... 10-085386

[51] Int. Cl.[7] ..... F02F 7/00

[52] U.S. Cl. ..... 123/195 R; 123/195 A; 123/195 H; 123/41.74

[58] Field of Search ..... 123/195 R, 195 A, 123/195 H, 41.74

[56] References Cited

U.S. PATENT DOCUMENTS

| | | | |
|---|---|---|---|
| 4,237,847 | 12/1980 | Baugh et al. | 123/195 R |
| 4,712,517 | 12/1987 | Anno et al. | 123/41.74 |
| 5,016,584 | 5/1991 | Inoue et al. | 123/195 R |
| 5,203,441 | 4/1993 | Monette . | |
| 5,247,915 | 9/1993 | Sasada et al. | 123/195 H |
| 5,501,189 | 3/1996 | Bezeij | 123/193.1 |
| 5,662,080 | 9/1997 | Toshiyuki et al. . | |
| 5,669,346 | 9/1997 | Leweux et al. | 123/195 R |
| 5,682,850 | 11/1997 | Yutaka . | |
| 5,901,680 | 5/1999 | Ozeki | 123/195 R |

FOREIGN PATENT DOCUMENTS

| | | |
|---|---|---|
| 0368 478 | 5/1990 | European Pat. Off. . |
| 0411 319 | 2/1991 | European Pat. Off. . |
| 0677 652 | 10/1995 | European Pat. Off. . |
| 0705 964 | 4/1996 | European Pat. Off. . |
| 2 201 197 | 8/1988 | United Kingdom . |
| 2 228 047 | 8/1990 | United Kingdom . |
| WO 94 07017 | 3/1994 | WIPO . |

OTHER PUBLICATIONS

European Search Report dated Jan. 12, 2000.

*Primary Examiner*—Tony M. Argenbright
*Assistant Examiner*—Hai Huynh
*Attorney, Agent, or Firm*—Knobbe, Martens, Olson & Bear LLP

[57] ABSTRACT

A lightweight high-strength cylinder block that is configured so as to provide an enlargement at one end thereof that defines a bell housing. The enlargement is provided with cavities, however, so as to lighten the weight of the cylinder block without substantially reducing its strength. At least one of these cavities can provide for communication of oil return and/or crankcase ventilating gases and also may function as a thermostat housing. An embodiment wherein the cylinder block extends below the crank shaft axis to form the upper portion of the crankcase is also disclosed.

12 Claims, 9 Drawing Sheets

ENGINE CYLINDER BLOCK

BACKGROUND OF THE INVENTION

This invention relates to an internal combustion engine cylinder block and more particularly to an improved lightweight, compact, high strength cylinder block for engines.

It is well known that there is a great desire to improve the performance of engines by reducing their weight and size without sacrificing engine performance or durability. Obviously, this is an understandable goal, but one which is not always easy to achieve.

With most engines, the cylinder block performs a number of functions in addition to merely defining the cylinder bores in which the pistons reciprocate. Generally, the engine's cylinder block is formed with a cooling jacket which surrounds the cylinder bores and which also provides communication between the cooling jackets of the cylinder block and other portions of the engine, such as the cylinder head and, at times, manifolds.

Furthermore, when overhead valve arrangements are employed, the cylinder block must provide a passage for lubricant to return to the crankcase chamber from the cylinder head valve chamber. Also, it is desirable to provide ventilating air passages through which crankcase ventilating gases may pass to the valve chamber of the cylinder head for possible induction into the engine combustion chambers to reduce the emission of unburned hydrocarbons to the atmosphere.

In addition to these functions, the cylinder block generally forms a bell housing which at least partially encircles the flywheel at one end of the engine. Generally, the flywheel has a larger diameter than the transverse dimension of the cylinder block and hence, this bell housing portion is formed as an enlargement at one end of the cylinder block. This may provide a difficult shape to cast or otherwise form, and may also add unnecessarily to the overall weight and bulk of the cylinder block.

Finally, the cylinder block normally forms at least a portion of the bearing surfaces for the crankshaft. Therefore, it should be readily apparent that the cylinder block performs a number of functions in addition to forming the cylinder bore. Thus, the prior art type cylinder blocks have been rather massive in size and weight.

It is, therefore, a principle object of this invention to provide an improved, lightweight, compact cylinder block for an internal combustion engine. It is a further object of this invention to provide an engine cylinder block that will provide all of the functions normally served by a cylinder block and yet in a more compact and lighter weight arrangement.

SUMMARY OF THE INVENTION

This invention is adapted to be embodied in a cylinder block for an engine that defines a plurality of inline cylinder bores. A bell housing is formed integrally at one end of the cylinder block and is adapted to contain at least in part a flywheel fixed to one end of a crankshaft that is rotatably journaled within the cylinder block. The bell housing is formed at least in part by a widened area of the cylinder block that extends forwardly from the one end thereof to a point which terminates at a distance from the one end that is not less than the distance to the second most cylinder bore from that end. A passageway is formed in the external walls of this extending portion of the cylinder block so as to lighten its weight and also permit possible passage of fluids between the cylinder block and at least one of a crankcase member or a cylinder head member either of which is affixed to the cylinder block.

DETAILED DESCRIPTION OF THE PREFERRED EMBODIMENTS

Figure 1:
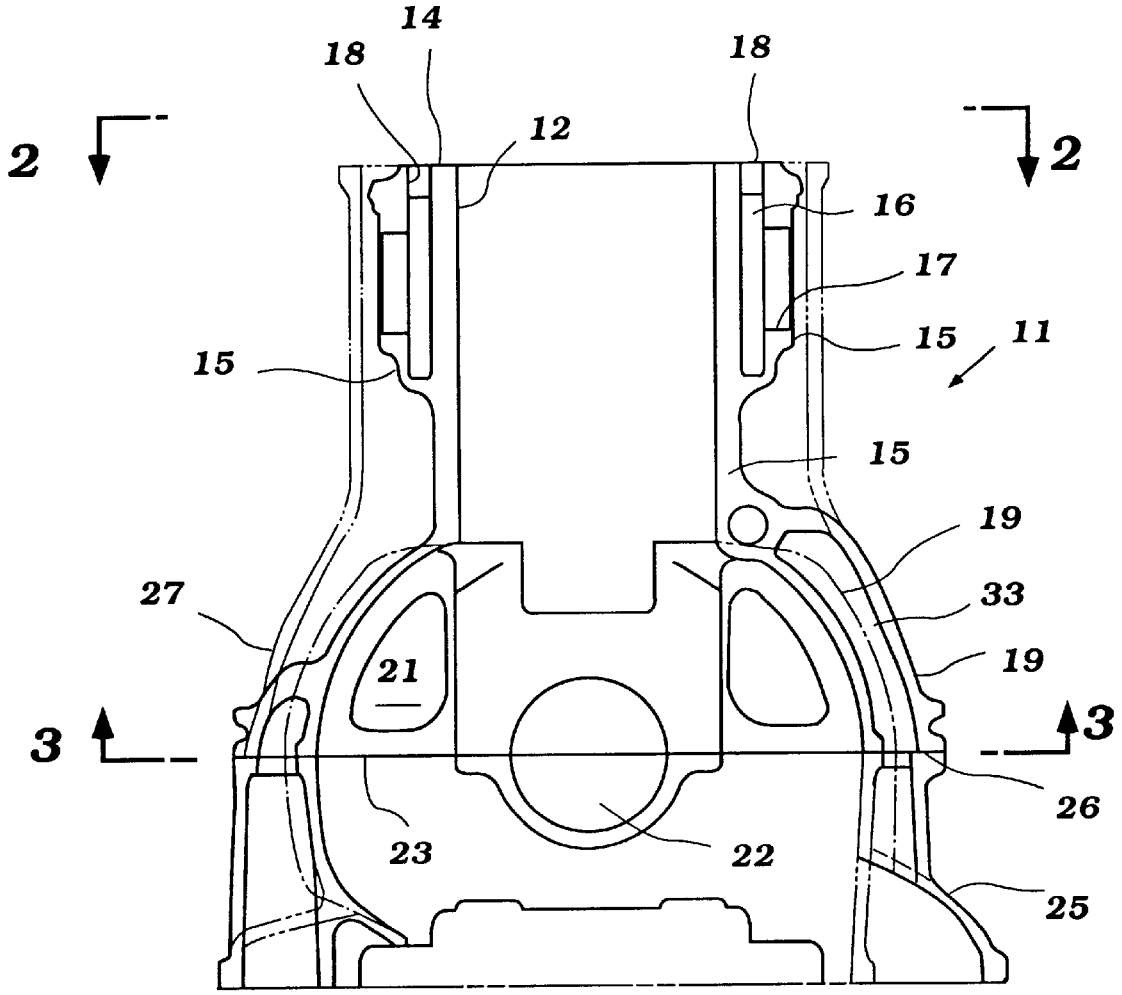
FIG. 1 is a cross-sectional view taken through the axis of one of the cylinder bores and showing corresponding sections of other cylinder bores in phantom.
Figure 2:
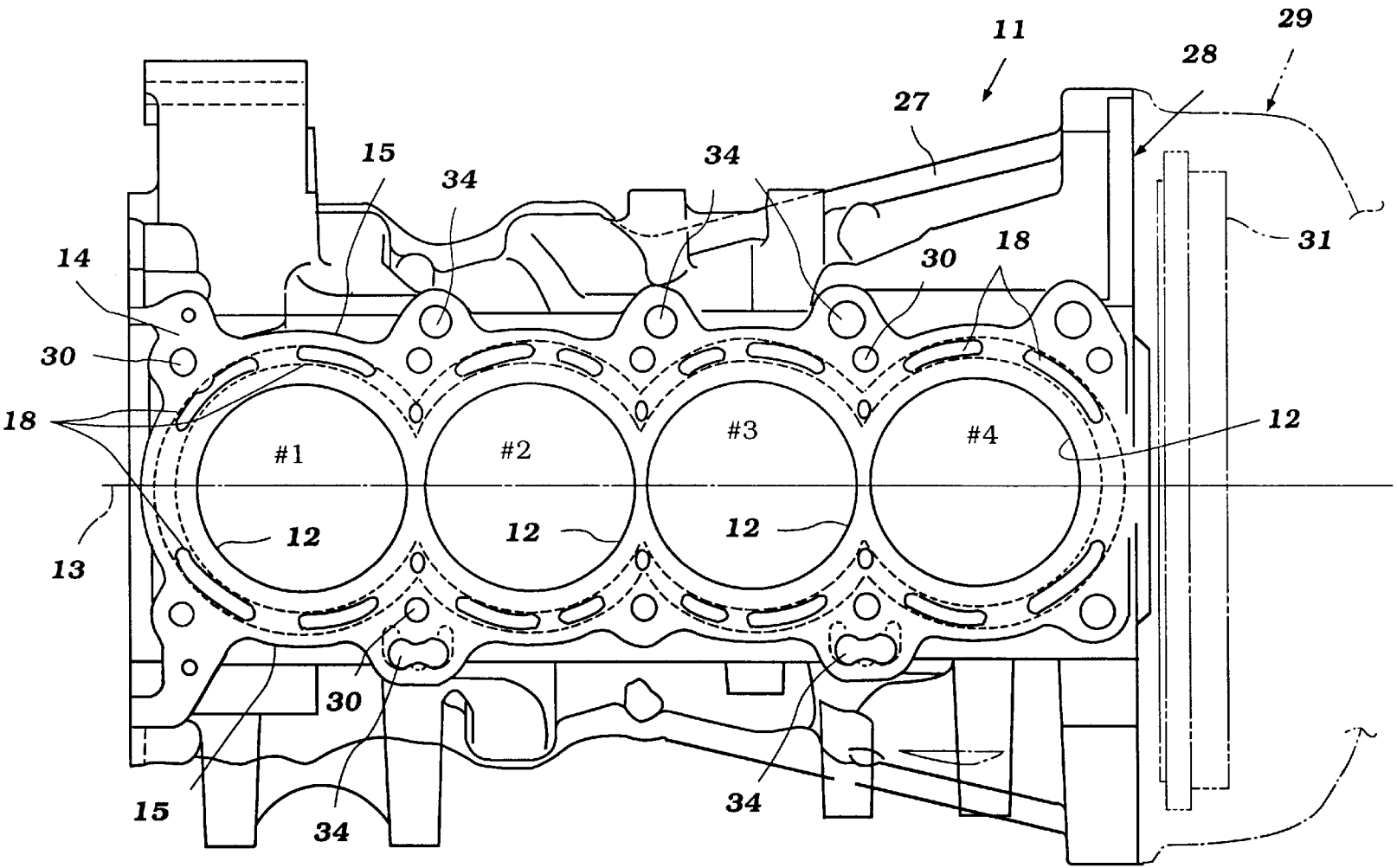
FIG. 2 is a top plan view of the cylinder block shown in FIG. 1, looking in the direction of the line 2—2 thereof, with the flywheel and transmission case associated with it shown in phantom.
Figure 3:
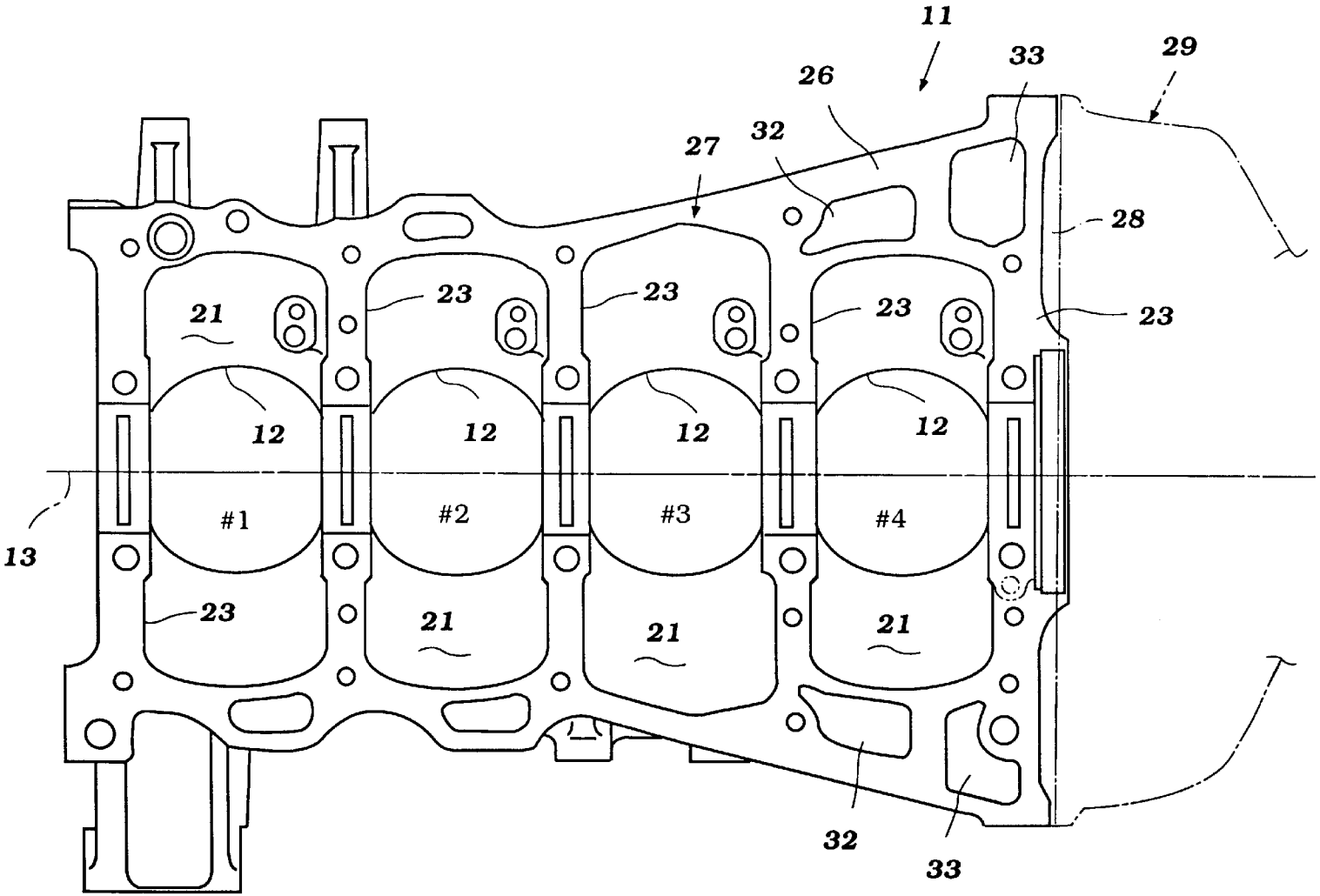
FIG. 3 is a bottom plan view of the same components shown in FIG. 2, looking in the direction of the line 3—3 of FIG. 1.

Referring now in detail to the embodiment of FIGS. 1–7 and initially primarily to FIGS. 1–3, a cylinder block constructed in accordance with this embodiment is indicated generally by the reference numeral 11. The cylinder block 11 is formed preferably as a casting from a suitable material normally utilized for such cylinder blocks. This may be either cast iron or aluminum or other lightweight metal or metal alloy of such materials.

The cylinder block 11 is depicted as being of the in-line type, and defines four cylinder bores indicated by numbers 1, 2, 3 and 4, each cylinder bore being identified specifically by the reference numeral 12. The cylinder bores 12 have their axes lying along a common plane 13 that extends from the front end of the engine, i.e., that adjacent cylinder number 1, to the back end of the engine, i.e., that adjacent the cylinder bore indicated as number 4.

Although the invention is described in conjunction with an in-line engine, it may also be used with V-type engines, but has particular utility in conjunction with in-line engines.

The cylinder block 11 has an upper surface or deck 14 through which the upper ends of the cylinder bores 12 extend. Basically, the forward portion of the cylinder block 12 has an outer wall surface 15 that is disposed closely adjacent the respective cylinder bores 12, leaving only room for a water jacket 16 to be formed there around. The water jackets 16 have core openings 17 at spaced locations along their length so as to permit core sand to be removed after the casting process. These core openings 17 will then be closed by freeze plugs, as is well known in this art.

The cylinder block cooling jackets 16 communicate with corresponding cooling jackets formed in the cylinder head through slotted openings 18 formed in the deck 14 in a manner that is well known in this art. The cylinder head (not shown) has cooperating, communicating openings through which the liquid coolant may pass.

Below the cylinder bores 12, the wall portion 15 flares outwardly, as at 19, so as to form crankcase chambers 21 in which a crankshaft, indicated schematically at 22, is journaled by web portions 23 of the cylinder block 12 to which bearing caps (not shown) are affixed in a known manner. The axis of rotation of the crankshaft 22 lies on the plane 13.

The web portions 23 are separated by enlarged chambers which form the crankcase chambers 21 of the engine along with a crankcase member which may be affixed thereto in a suitable manner. In this embodiment, this crankcase member is comprised of an upper crankcase piece 25 that is affixed to the lower surface 26 of the cylinder block 12 in a suitable manner. The lower surface of this upper crankcase member 25 may be closed by a lower blanking plate, which is not shown.

As may be best seen in FIG. 2, the rear end of the cylinder block 11 is provided with a section which tapers outwardly from the forward parts thereof, and which is indicated generally by the reference numeral 27. This section 27 tapers outwardly and rearwardly to define a bell housing end 28 to which a transmission, clutch case 29 may be affixed.

A flywheel 31 is affixed to the rear end of the crankshaft 22 within this area. It may be seen that this outwardly tapering portion 27 begins at a point forwardly of the number 3 cylinder (the second cylinder from the rear face 31 of the cylinder block 11). This provides a fairly smooth transition and makes the cylinder block body 11 easier to form.

However, in order to avoid added weight by this extra section, there are provided a pair of cavities, indicated by the reference numerals 32 and 33. The cavity 33 is closest to the transmission case 29 and within the bell housing portion 27. This cavity 33 may serve a variety of functions, such as providing an oil return from the cylinder head through the cylinder block cavity 33 back to the crankcase chamber.

In addition, the chamber 32 may serve a similar function and thus provides a high strength and yet a minimum increase in the weight of the cylinder block 11.

The forward portion of the cylinder block may also be provided with cavities 34 that function as not only oil drains, but also crankcase ventilating passages along with the passages 32 and 33 so as to permit crankcase and blow by gases to travel upwardly to a valve chamber in the cylinder head. This valve chamber can communicate with the engine induction system through a crankcase ventilation system for recirculating crankcase gases to the combustion chamber. Thus, any hydrocarbons contained therein can be burned and will not be discharged to the atmosphere to provide effective emission control.

The cylinder block 11 is also provided with cylindrical openings 30 which are subsequently tapped to receive fasteners for fixing an associated cylinder head to the cylinder block.

Figure 4:
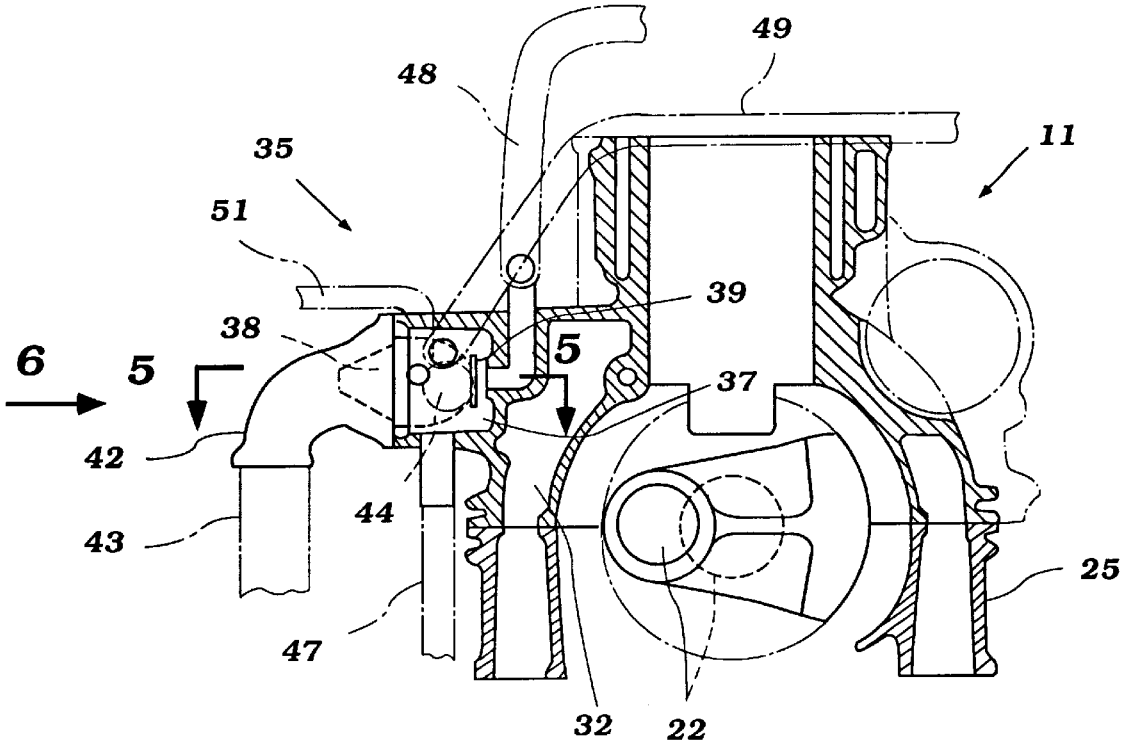
FIG. 4 is a cross-sectional view looking in the opposite direction from FIG. 1 and shows the thermostat housing arrangement in accordance with another feature of the invention.
Figure 5:
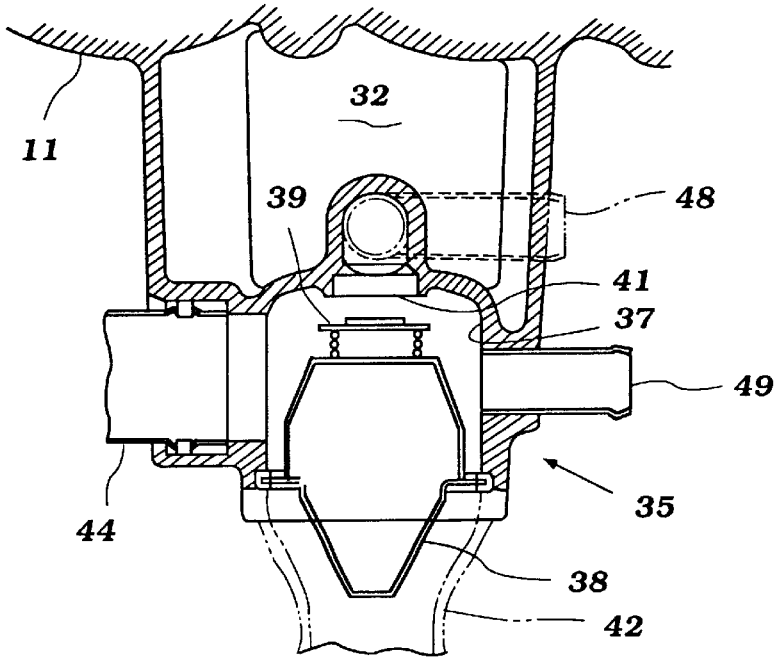
FIG. 5 is an enlarged cross-sectional view taken along the line 5—5 of FIG. 4.
Figure 6:
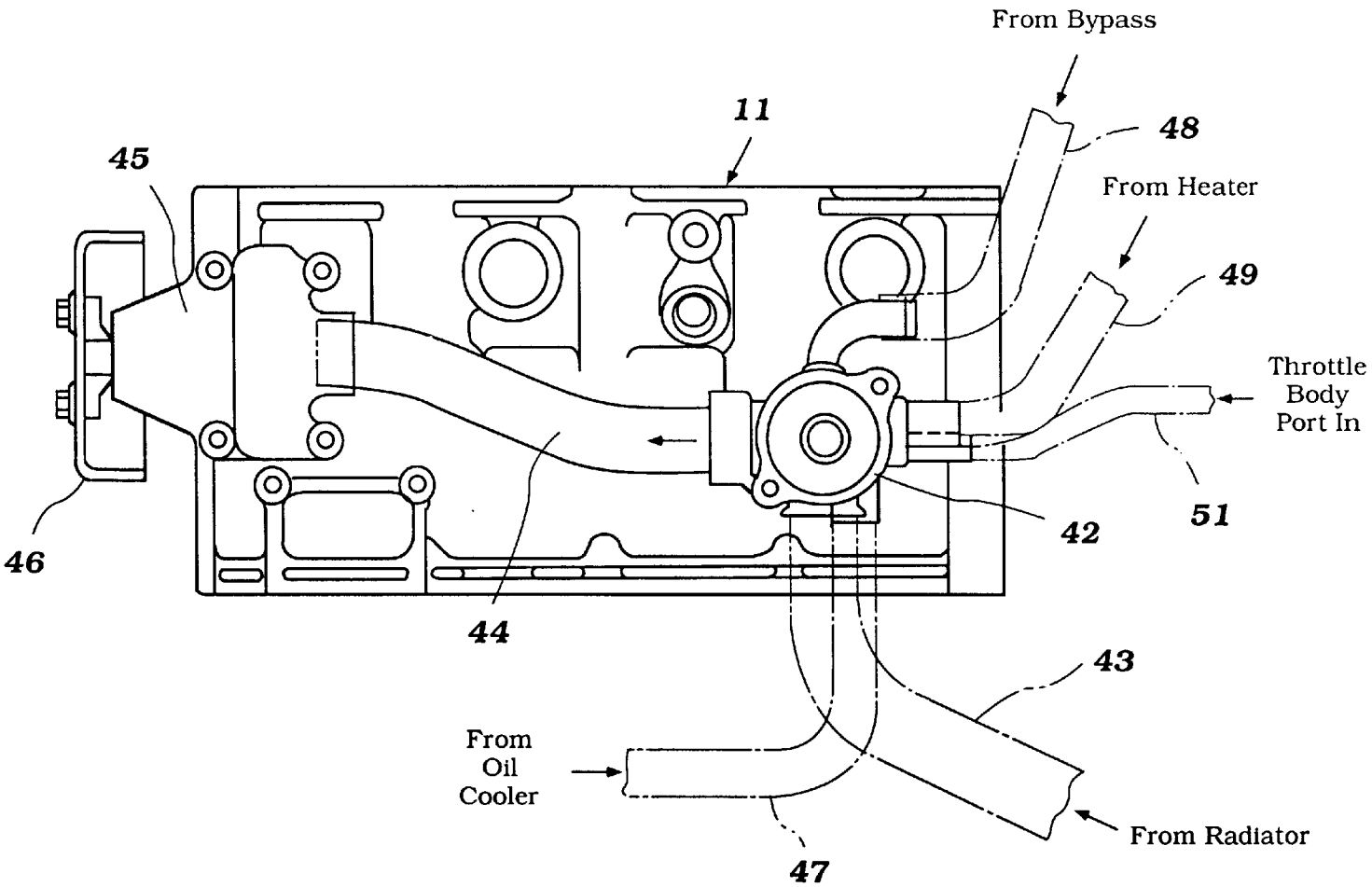
FIG. 6 is a partial, side elevational view looking in the direction of the arrow 6 in FIG. 4.
Figure 7:
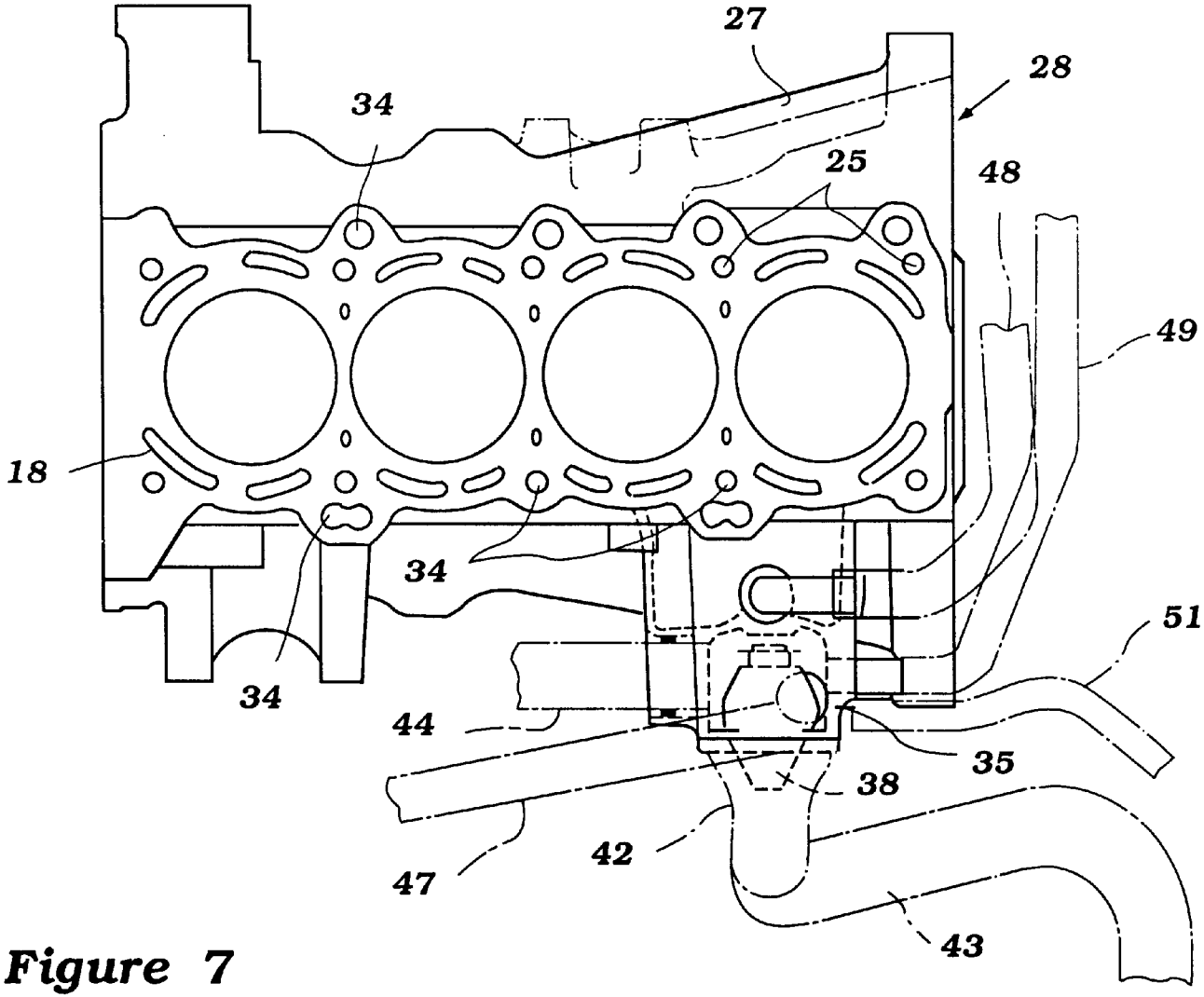
FIG. 7 is a top plan view, in part similar to FIG. 2 on a smaller scale, but shows the thermostat arrangement in place in the overall engine construction.
Figure 8:
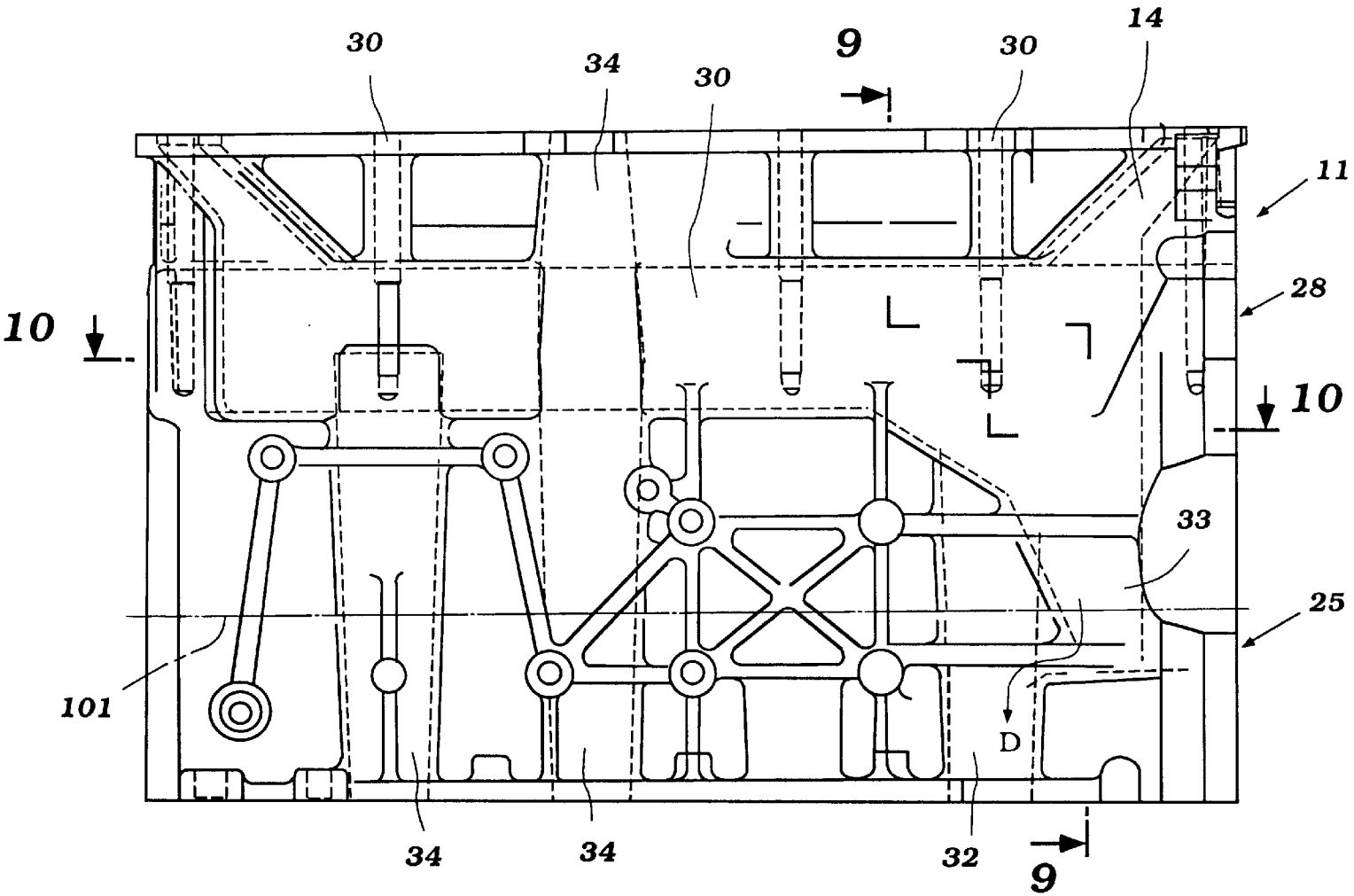
FIG. 8 is a side elevational view of a cylinder block constructed in accordance with a second embodiment of the invention.
Figure 9:
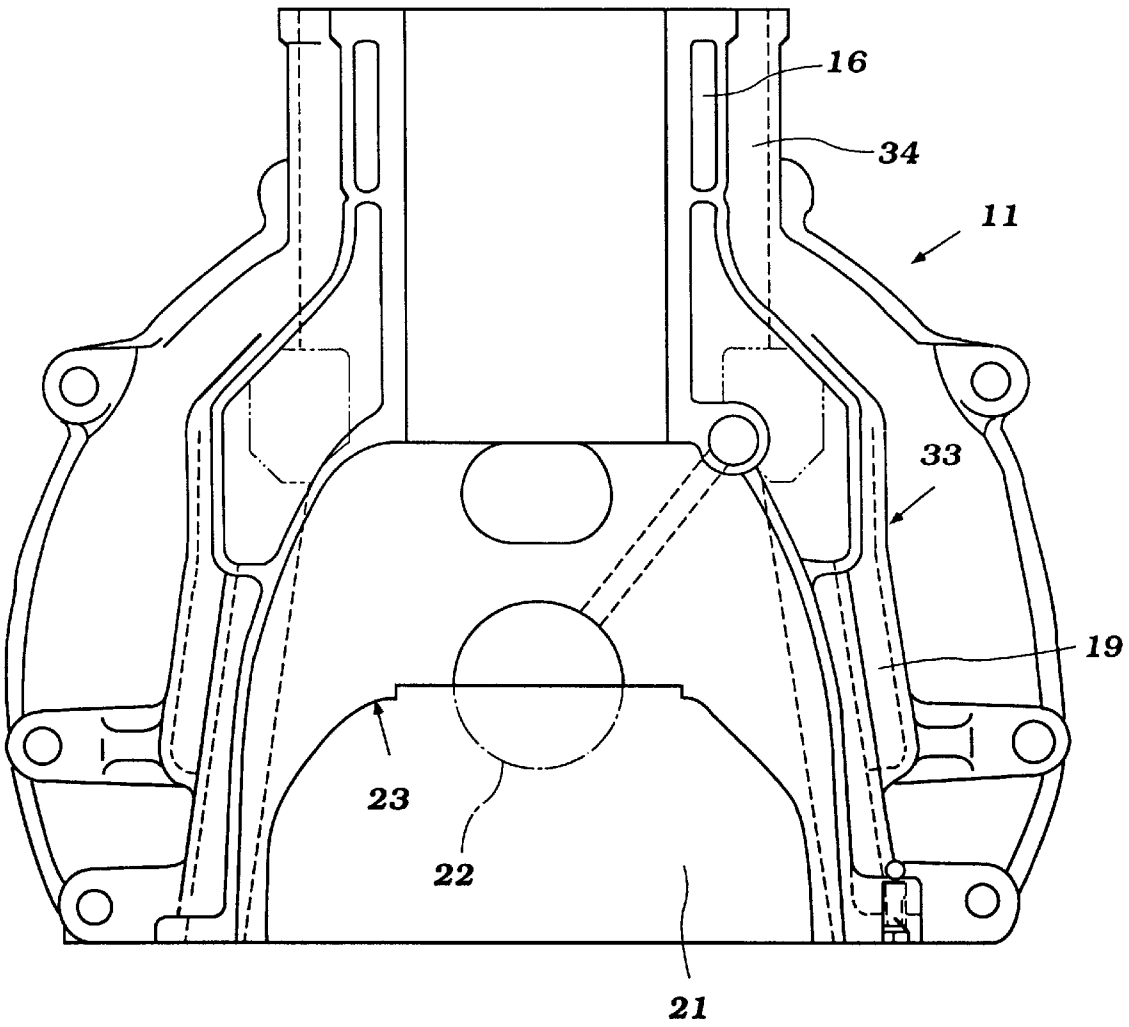
FIG. 9 is a cross-sectional view taken along the line 9—9 of FIG. 8.
Figure 10:
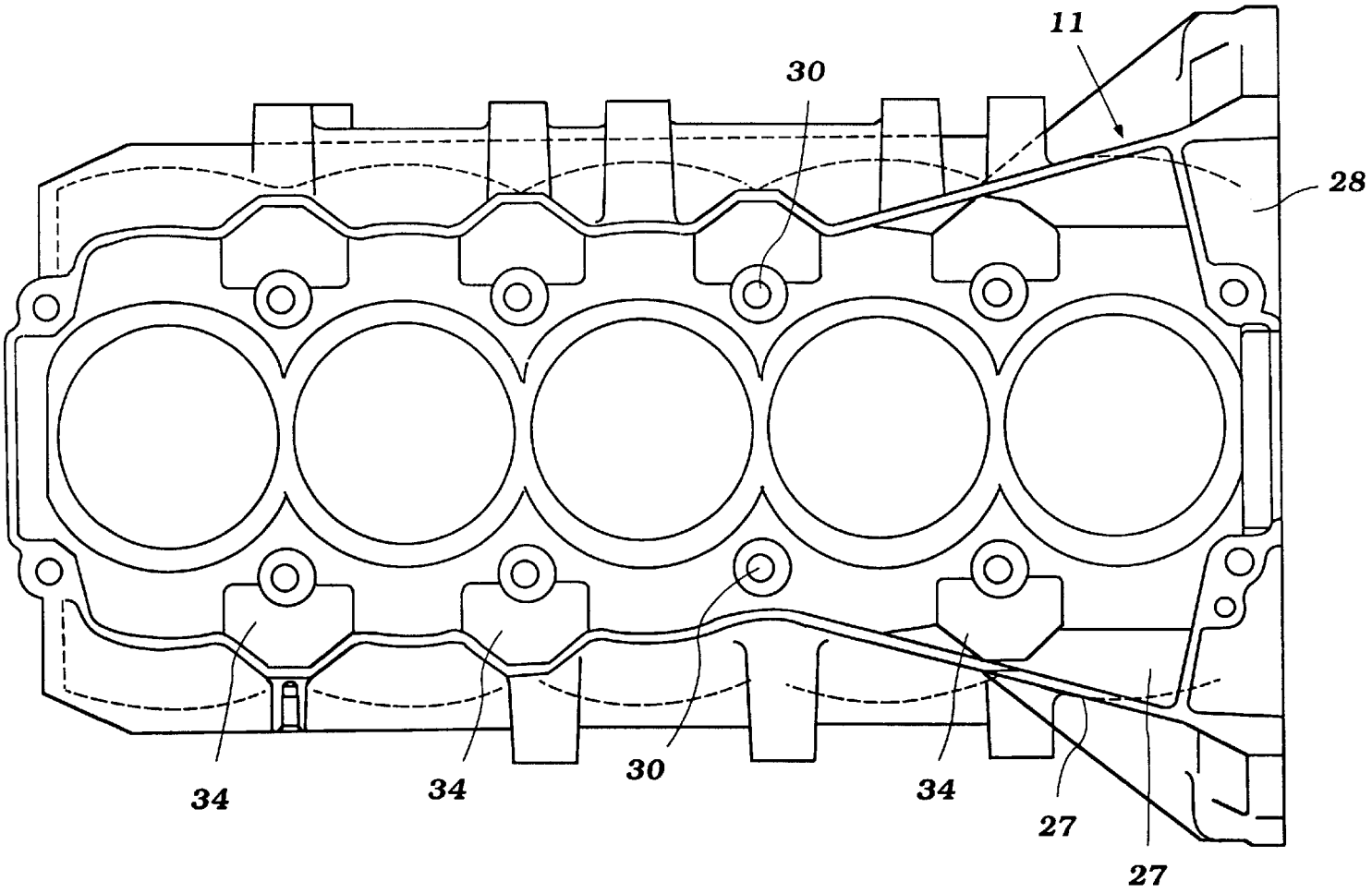
FIG. 10 is a cross-sectional view taken along the line 10—10 of FIG. 8.

As may be best seen in FIGS. 4–6, this enlarged portion 27 at the rear of the cylinder block may, at one side, also provide an arrangement to provide a thermostat housing, indicated generally by the reference numeral 35. This thermostat housing 35 can extend in part into a further cavity 37 formed at the upper portion of one of the cavities 32 or 33. A thermostatic valve 38 may be formed in this cavity 37, and has a valve element 39 that controls the opening and closing of a port 41.

The outer end of the thermostat housing opening 37 is closed by means of a closure plate 42. This closure plate 42 defines a conduit 43 that is connected to the heat exchanger or radiator associated with the engine with which the cylinder block 11 is utilized. A delivery conduit 44 communicates with the thermostat housing 35 and delivers coolant to a coolant pump 45 that is mounted on the forward side of the cylinder block as seen in FIG. 5. This water pump 45 has a pulley 46 that is driven by a drive belt or the like and circulates water to the engine cooling jacket.

There may be provided an oil cooler for the engine and return water from this oil cooler is returned to the thermostat housing 35 through a return line 47.

A bypass line 48 is also connected to the thermostat housing for receiving coolant that is bypassed around the engine and which flows into the thermostat housing when the thermostatic valve element 39 is open.

A heater return conduit 49 also returns liquid coolant to the thermostat housing cavity 37.

An additional pipe 51 also supplies coolant back to the thermostat housing from a throttle body portion.

In the embodiment as thus far described, the cylinder block 11 has been formed as a separate piece from the upper crankcase member portion 25. FIGS. 8–11 show another embodiment of the invention which is basically the same as the embodiment previously described. In this embodiment, however, the crankcase member portion 25 is formed integrally with the cylinder block portion.

Therefore, the cylinder block body 11 extends below a horizontal plane 101 which corresponds to the lower face 26 of the cylinder block in the previous embodiment. This provides a deepening of the cylinder block and further reinforces its strength. Because the components of this embodiment are the same as those previously described except for those differences, they have been identified by the same reference numeral. It is believed that those skilled in the art will readily understand how the two pieces can be formed as a single piece in this embodiment.

Thus, from the foregoing description it should be readily apparent that the described embodiments of the invention provide very compact and yet high strength and lightweight cylinder blocks for an engine. Of course, the description is that of preferred embodiments of the invention and various changes and modifications may be made without departing from the spirit and scope of the invention, as defined by the appended claims.

What is claimed is:

1. A cast cylinder block for an engine defining a plurality of inline, cylinder bores, a bell housing formed integrally at one end of said cylinder block and adapted to contain at least in part a flywheel fixed to one end of a crankshaft that is rotatably journaled within said cylinder block, said bell housing being formed at least in part by a widened area of said cylinder block that extends forwardly from the one end thereof to a point which terminates at a distance from said one end that is not less than the distance to the second most cylinder bore from said one end, a cavity formed between the external walls of said widened area of said cylinder block so as to lighten its weight, said cavity having an open end communicating with a cavity in one of a cylinder head and a crankcase member affixed to said cylinder block for passage of fluids between said cylinder block and the at least one of the crankcase member and cylinder head.

2. A cylinder block for an engine as set forth in claim 1 wherein the cavity communicates with a cavities in both of the cylinder head and the crankcase member for passage of fluids between the crankcase member and the cylinder head through said cylinder block cavity.

3. A cylinder block for an engine as set forth in claim 1 wherein the widened area extends beyond a second cylinder bore from the one end and tapers in width from that point to said one end.

4. A cylinder block for an engine as set forth in claim 3 wherein the widened area does not extend to an axis of a third cylinder bore from the one end.

5. A cylinder block for an engine as set forth in claim 1 wherein the cavity cooperates to form a thermostat housing for a liquid cooling system of the associated engine.

6. A cylinder block for an engine as set forth in claim 1 wherein said cylinder block defines a plurality of spaced journal surfaces for rotatably journalling a crankshaft for rotation about a crankshaft axis spaced from the cylinder bores.

7. A cylinder block for an engine as set forth in claim 6 wherein the outer periphery of said cylinder block extends beyond a plane perpendicular to the axes of the cylinder bores and containing the crankshaft axes.

8. A cylinder block for an engine as set forth in claim 7 wherein the cavity communicates with a crankcase chamber formed in the portion of the cylinder block extending on the other side of the perpendicular plane from the cylinder bores.

9. A cylinder block for an engine as set forth in claim 8 wherein the cavity communicates with a cavities in an associated cylinder head fixed to said cylinder block for passage of fluids between the crankcase chamber.

10. A cylinder block for an engine as set forth in claim 7 wherein the widened area extends beyond a second cylinder bore from the one end and tapers in width from that point to said one end.

11. A cylinder block for an engine as set forth in claim 10 wherein the widened area does not extend to an axis of a third cylinder bore from the one end.

12. A cylinder block for an engine as set forth in claim 7 wherein the cavity cooperates to form a thermostat housing for a liquid cooling system of the associated engines.

* * * * *